US010001334B1

(12) United States Patent
Farchione, Jr. et al.

(10) Patent No.: US 10,001,334 B1
(45) Date of Patent: Jun. 19, 2018

(54) DISCHARGE PREVENTER ASSEMBLY

(71) Applicant: Regal Industrial Sales, Inc., Victor, NY (US)

(72) Inventors: Patrick Farchione, Jr., Victor, NY (US); Thomas J. Farchione, Victor, NY (US)

( * ) Notice: Subject to any disclaimer, the term of this patent is extended or adjusted under 35 U.S.C. 154(b) by 0 days. days.

(21) Appl. No.: 15/466,905

(22) Filed: Mar. 23, 2017

(51) Int. Cl.
*F41A 17/00* (2006.01)
*F41A 17/54* (2006.01)

(52) U.S. Cl.
CPC ..... *F41A 17/54* (2013.01)

(58) Field of Classification Search
CPC ..... F41A 17/00; F41A 17/02; F41A 17/30; F41A 17/32; F41A 17/34; F41A 17/36; F41A 17/46; F41A 17/53; F41A 17/54
See application file for complete search history.

(56) References Cited

U.S. PATENT DOCUMENTS 3,307,755 A * 3/1967 Lentz ..... F41C 33/06 206/317
5,611,164 A * 3/1997 Rassias ..... F41A 17/44 42/44
5,680,723 A * 10/1997 Ruiz ..... F41A 17/44 42/70.07
5,720,193 A * 2/1998 Dick ..... E05B 37/00 211/64
6,568,117 B2 * 5/2003 Weinraub ..... F41A 17/54 42/70.07
6,694,659 B2 * 2/2004 Olsen ..... F41A 17/44 42/70.01
9,841,250 B1 * 12/2017 Mirza ..... F41A 35/02
2007/0017137 A1 * 1/2007 Farchione ..... F41A 17/54 42/70.08
2012/0005935 A1 * 1/2012 Chandler ..... F41A 17/04 42/70.11
2013/0312308 A1 * 11/2013 McCarthy ..... F41A 35/02 42/96

* cited by examiner

*Primary Examiner* — Gabriel Klein
(74) *Attorney, Agent, or Firm* — Bennet K. Langlotz; Langlotz Patent & Trademark Works, Inc.

(57) ABSTRACT

This invention provides a discharge preventer assembly for a firearm that is a supplemental safety attachment for a firearm. The discharge preventer assembly can be made of a left body portion and a right body portion which can be adapted to connect to each other in a protective condition to collectively receive and enclose a trigger bow and a trigger; and at least one of the left body portion and the right body portion having a bolt block element protruding upward and adapted to be received in the bolt passage when the left body portion and the right body portion are in the protective condition. The discharge preventer assembly can also include one or more rigid plates configured to be positioned adjacent the right body portion or the left body portion.

20 Claims, 8 Drawing Sheets

DISCHARGE PREVENTER ASSEMBLY

FIELD OF THE INVENTION

The present invention relates to a discharge preventer assembly and, more particularly, to a discharge preventer assembly that secures both the trigger and the cartridge chamber to increase the safety of a firearm.

BACKGROUND OF THE INVENTION

Firearms generally have a trigger guard to prevent an accidental discharge or firing of a weapon by fending off inadvertent brushing by a hand or other implement. One such trigger guard is a stock ring-type trigger guard that keeps the trigger from being pulled inadvertently. The ring-type trigger guard wraps around the trigger in a halo-like arrangement. However, accidental discharges can still occur with traditional trigger guards. Additionally, it is generally known that the occurrence rate of an accidental discharge is higher for rifles than hand-guns. Even with a traditional trigger guard present, accidental discharge can still occur for a number of reasons such as a failure related to loading or unloading the weapon. Similarly, an accidental discharge can occur while drawing or holstering a weapon if the safety is not secure, such as for example, if a holster's thumb-break becomes tangled in the trigger and results in the discharge of a weapon.

Additionally, bolt-action firearms, typically used in hunting applications, have both a safety and a bolt latch for securing the bolt locked in a closed position. Thus, in a hunting application these two features allow the rifle to be carried in the field loaded and cocked without the high risk of accidental discharge.

It is also important to be able to store a firearm in a way that it is rendered safe and inoperable. This is to protect against children discharging the firearm, and unauthorized users such as home invaders from using a stored firearm to threaten or harm the owners. Existing trigger locks serve to cover the trigger guard against normal operation by a trigger finger, but these do not necessarily prevent other accidental discharges, nor do they prevent an unloaded firearm from being loaded.

Thus, it is desirable to have an additional protection mechanism to keep the trigger from being moved or pulled if the safety is in the off position. A need exists in the industry to provide a supplemental mechanism for a firearm, particularly for rifles, to reduce the rate of accidental discharge over and above the protection provided by a traditional trigger guard.

SUMMARY OF THE INVENTION

One aspect of the disclosure is directed to a discharge preventer assembly for a firearm having a trigger guard assembly, and defining a bolt passage with a bolt operable between a battery position in which the bolt abuts a breech face and a position when the bolt is spaced apart from the breech face, the firearm defining a magazine well having a lower opening, the breech face forward of the opening, and the bolt being rearward of the opening when in the retracted position. The discharge preventer assembly can be made of a first body portion and a second body portion. The first body portion and the second body portion can be adapted to connect to each other in a protective condition to collectively receive the trigger bow of the trigger guard assembly and the trigger, and to enclose the trigger bow and trigger; and at least one of the left body portion and the right body portion can have a bolt block element protruding upward and adapted to be received in the bolt passage when the first body portion and the second body portion are in the protective condition. The discharge preventer assembly can also include a rigid plate configured to be positioned adjacent the first body portion or the second body portion.

Another aspect of the present disclosure is directed to a discharge preventer assembly wherein the firearm defines a lower stock plane, wherein the trigger bow is below the lower stock plane, and the magazine well is above the lower stock plane, and wherein the first and second body portions collectively define a upper plane registered with the lower stock plane when the discharge preventer assembly is installed, the bowed space being below the upper plane and the bolt block element is above the lower plane.

This inventive subject matter includes a trigger lock for a firearm having a frame, a trigger protruding from the frame, and a magazine well in the frame. The trigger lock is made of a first body portion and a second body portion adapted to be secured to the first body portion in a locked condition. The first body portion and the second body portion collectively define a protective space adapted to protectively receive the trigger of the firearm. At least one of the first body portion and the second body portion includes a bolt blocking element configured to protrude into the magazine well, when in the locked condition.

This inventive subject matter provides a method to prevent a firearm from accidentally firing. The method includes the steps of: providing the discharge preventer assembly and forming the protective condition, wherein the bolt is prevented from contacting the breech face and wherein the bolt block element is adapted to prevent installation of a magazine in the magazine well.

BRIEF DESCRIPTION OF THE DRAWINGS

The invention can be best understood by those having ordinary skill in the art by reference to the following detailed description when considered in conjunction with the accompanying drawings in which.

DESCRIPTION OF THE CURRENT EMBODIMENT

Figure 1:
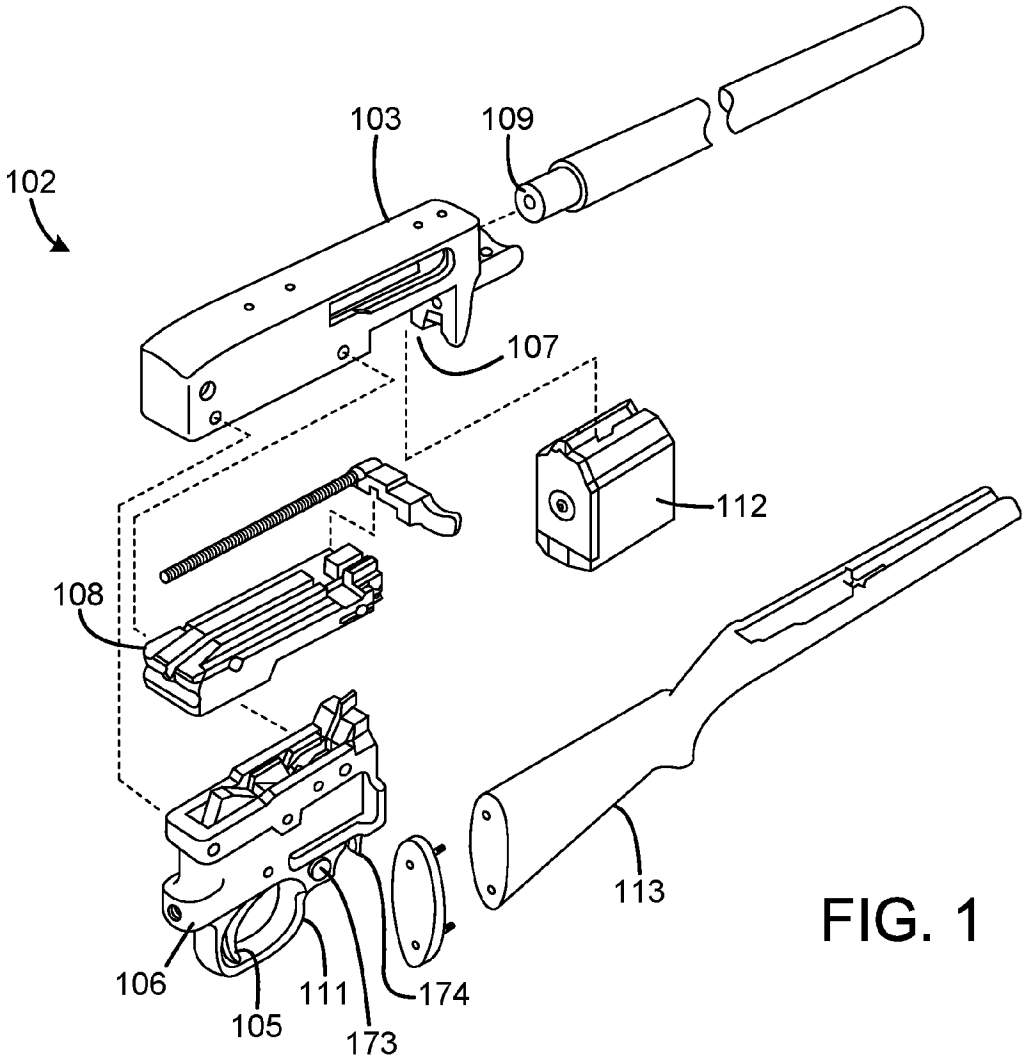
FIG. 1 is an exploded isometric view of a traditional firearm.

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification containing the appended claims, the singular forms "a," "an," and "the" include the plural, and reference to a numerical value includes at least that particular value, unless the context clearly dictates otherwise. Ranges may be expressed herein as from "about" or "approximately" one value and/or to "about" or "approximately" another particular value.

FIGS. 1-7 illustrate an embodiment of a discharge preventer assembly, generally designated by reference numeral 100. The discharge preventer assembly 100 is a supplemental assembly that can be added to a firearm to prevent accidental firing. In one aspect, the discharge preventer assembly 100 is configured to stabilize the trigger and a trigger bow while also preventing installation of a magazine in the magazine well of the firearm or loading a cartridge into the bolt. Additionally, further features and elements can be included to provide redundant methods of preventing discharge.

Figure 2:
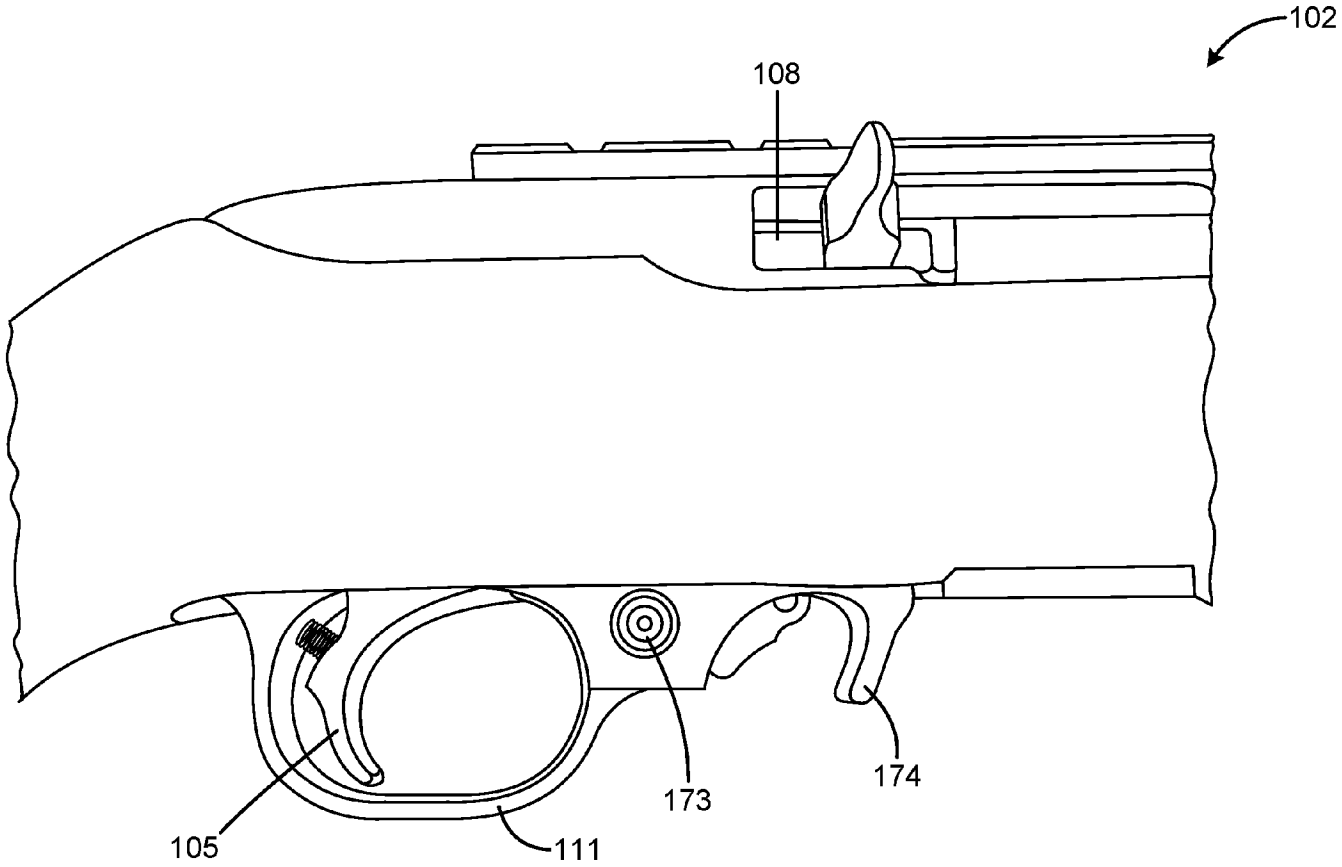
FIG. 2 is a side-view of a traditional firearm.

Now referring to FIGS. 1 and 2, a firearm 102, such as a rifle, is shown without the discharge preventer assembly. A standard firearm 102 includes: a frame 103, a trigger 105 and a trigger guard assembly 106 protruding from the frame 103. A trigger guard assembly 106 is configured to include a trigger bow 111 surrounding the trigger 105 of the firearm 102 and is configured to reduce the chance of an accidental discharge of the weapon. Additionally, a standard firearm 102 traditionally includes a safety 173 positioned to prevent the standard firearm 102 from firing. In a standard firearm, a bolt 108 contacts the breech face 109. The magazine well 107 is open to accept a magazine 112. A magazine release 174 is configured to control the release of the magazine 112 from the magazine well 107.

Figure 3A:
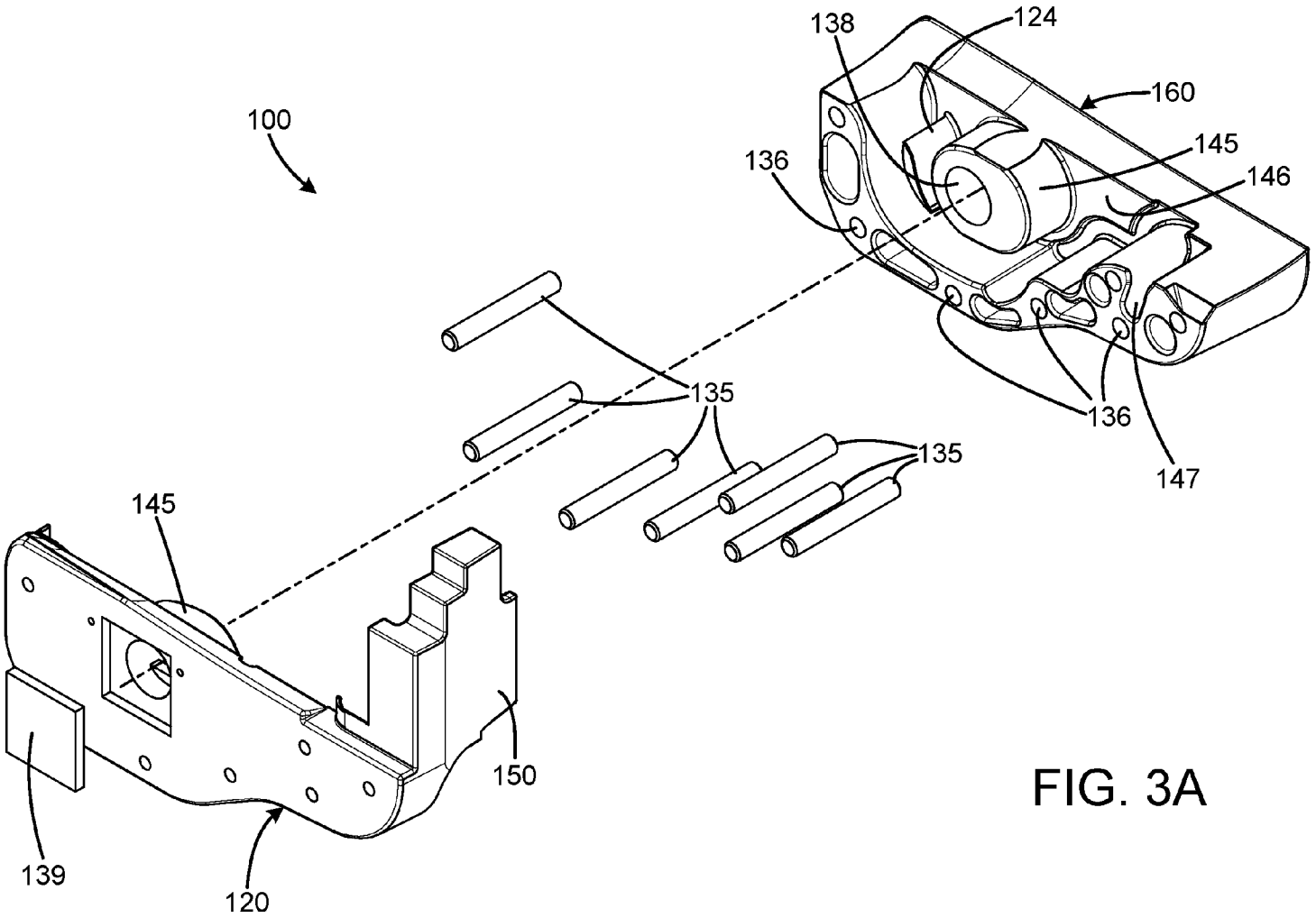
FIG. 3A is an exploded isometric view of both halves of the discharge preventer assembly.
Figure 3B:
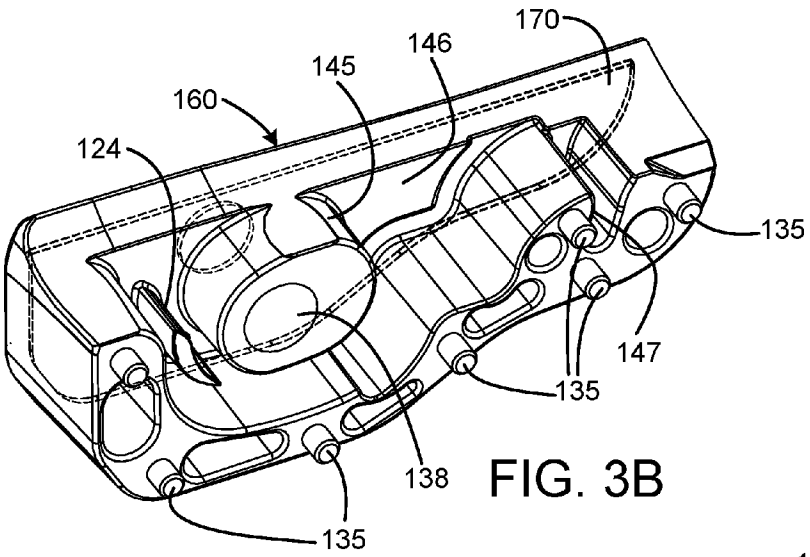
FIG. 3B is a perspective view of a first body portion.
Figure 3C:
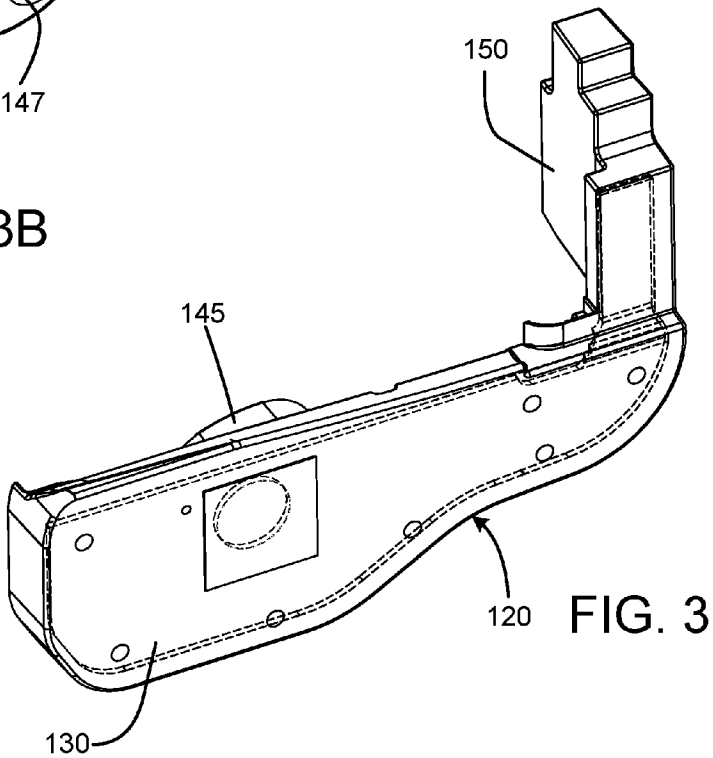
FIG. 3C is a perspective view of a second body portion.

Now referring to FIGS. 3A-3C, an exploded perspective view of the discharge preventer assembly 100 according to one embodiment is shown in FIG. 3A, and perspective views of the first and second body portions are shown in FIGS. 3B and 3C. The discharge preventer assembly 100 includes a first body portion a first body portion 120 and a second body portion 160 (also referred to herein as a right body portion 120 and a left body portion 160 respectively). The first body portion and the second body portion can connect together to enclose the trigger 105 and the trigger bow 111. The first body portion and the second body portion can each include a rigid plate 130, 170 integral with each of the respective body portions 120, 160. The first body portion 120 and the second body portion 160 can then be connected together through a plurality of reinforcing pins 135. The plurality of reinforcing pins 135 can abut the rigid plates through complementary apertures 136 in the respective body portions 120, 160. As such, a cage of reinforced plates and pins disposed within the first and second body portions can surround the trigger bow of the trigger guard assembly and mitigate attempts to saw or cut through the discharge preventer assembly.

The first body portion 120 and the second body portion 160 can be made of a rigid material, such as a plastic, a metal, or other material that provides sufficient rigidity to prevent accidental discharge of the firearm. In particular embodiments, the first body portion 120 and the second body portion 160 can be made of a thermoplastic resin, for example an acetal copolymer, DELRIN (DuPont), a die or an investment casting made of, for example, aluminum or zinc, a machined or unmachined metallic or non-metallic material, such as steel, or an additive manufacturing of machined metallic or non metallic material.

Referring in particular to FIGS. 3B and 3C, the discharge preventer assembly 100 can include a first rigid plate 130 positioned within the first body portion 120 and a second rigid plate 170 positioned within the second body portion. The first and second rigid plates 130 and 170 can be made of a hardened material and configured to resist unauthorized removal of the discharge preventer assembly by sawing or cutting through the first and second body portions. In particular, the first rigid plate 130 and the second rigid plate 170 can be made of a material that is harder than the first body portion 120 and the second body portion 160. Further, the first rigid plate 130 and the second rigid plate 170 can be made of a material that is denser than the first body portion 120 and the second body portion 160. In a very particular embodiment, the first body portion 120 and the second body portion 160 can be composed of a plastic material and the first rigid plate and the second rigid plate can be composed of a metal.

The plurality of reinforcing pins can be made of a hardened material, and particularly a material harder than the respective body portions. In particular embodiments, the plurality of reinforcing pins can be metal. The plurality of reinforcing pins can be arranged around the trigger bow 111 of the guard assembly 106. Together with the metal plates and the plurality of reinforcing pins a cage of hardened material can incase the trigger bow 111 of the trigger guard assembly 106.

By using a lighter and less expensive material for the first body portion and the second body portion, while also incorporating harder and stronger pins and plates, the overall weight and cost of the discharge prevent assembly is lowered while still robustly preventing unauthorized removal via sawing or cutting.

In one exemplary embodiment, the rigid plate 130 is coextensive with the trigger guard 106 and projects upwardly with the bolt block element 150.

In particular embodiments, the first body portion 120 can be overmolded onto the first rigid plate 130. Similarly, the second body portion 160 can be overmolded onto the second rigid plate 170 For example, the rigid plate can be place into a mold which is then injected with a resin that forms the body portion such that the rigid plate is permanently disposed within the body portion.

The first body portion and the second body portion of the discharge preventer assembly 100 can include a trigger block 145 which can be configured to secure the trigger 105 by filling the void space between the trigger 105 and the trigger bow 111 of the guard assembly 106. Thus, the first body portion 120 and the second body portion 160 can be adapted to connect to each other in the secured condition, collectively enclosing the trigger 105 and the trigger bow 111 of the guard 106. The trigger block 145 can define a space closely conforming to the trigger 105 and the trigger bow 111. For example, a projection 124 disposed on either the first body portion 120 and the second body portion 160 can function to block the space between the trigger 105 and the trigger bow 111. In particular embodiments, the projection can be ovoid shaped. The projection can prevent the insertion of a finger in front of the trigger 105.

Furthermore, the discharge preventer assembly 100 can include a bolt block element 150 disposed on the first body portion 120 or the second body portion 160. In particular embodiments, the bolt block element 150 can be disposed on the first body portion 120. The bolt block element 150 can be configured to be inserted into the bolt of a firearm, thereby preventing loading of a round into the chamber. Further, the bolt block element 150 of the discharge preventer assembly 100 can be positioned to prevent insertion of a magazine into the magazine well 107. The bolt block element 150 can be integral with a body portion, and in certain embodiments made of the same material as the body portion. In this way, the bolt can be blocked simultaneously with the trigger be secured within a single discharge preventer assembly.

In further embodiments, the discharge preventer assembly 100 can further include a raised surface 146, which is an elevated area configured to engage the safety 173 of the standard firearm 102. The raised surface 146 can be configured to prevent the safety 173 from being disengaged.

In still further embodiments, the discharge preventer assembly 100 can include a slot 147 configured to retain the magazine release 174 such that the magazine release is inaccessible when the discharge preventer assembly is installed.

In one exemplary embodiment, an aperture 138 may be disposed in both the first body portion 120 and the second body portion and adapted to allow a lock 139 to be inserted therein, keeping the discharge preventer assembly 100 secure from removal without first releasing the lock 139. This provides at least one of the left and right body portions including a lock 139 operably engaging the other of the right body portion 120 and left body portion 160.

Figure 4:
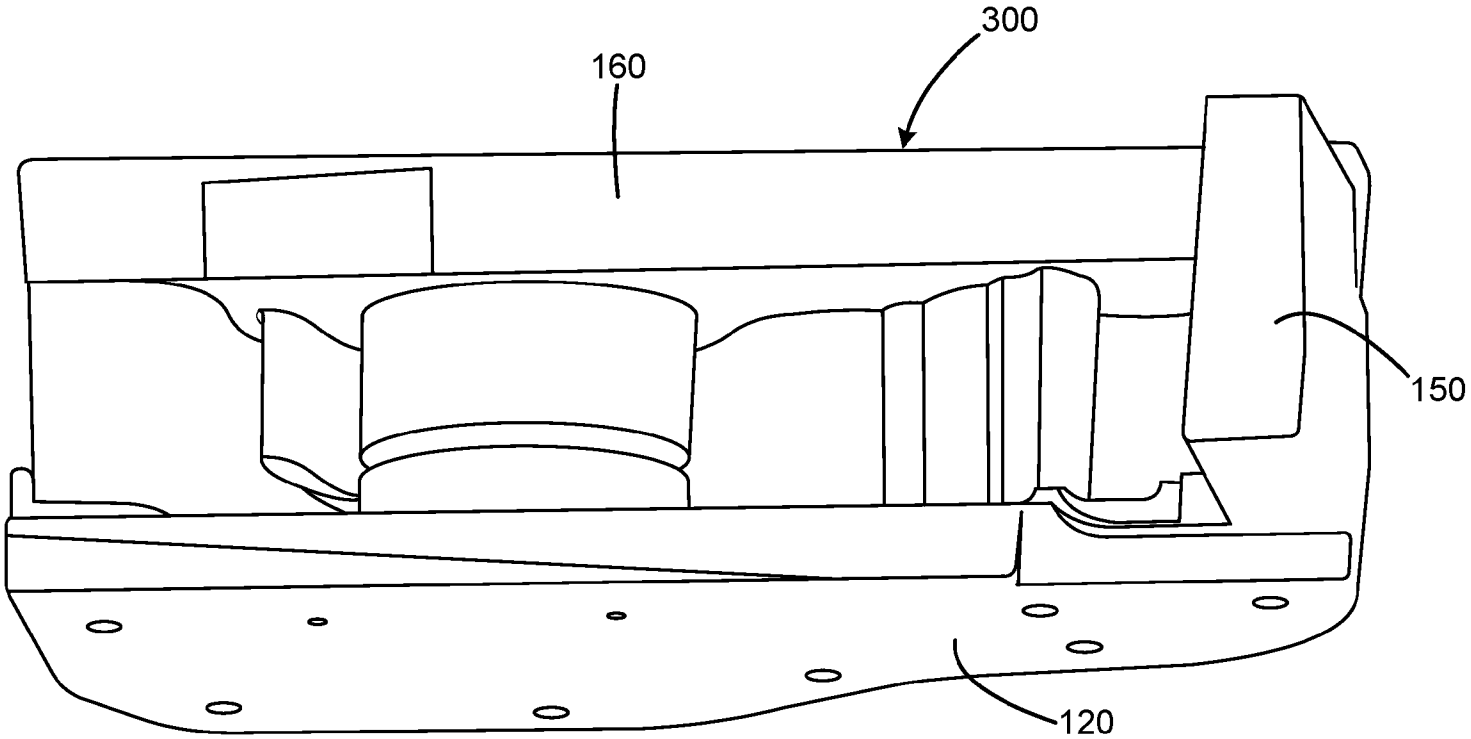
FIG. 4 is an assembled view of both halves of the discharge preventer assembly joined in the protective condition.

Now referring to FIG. 4, the right body portion 120 and the left body portion 160 are joined in the protective condition 300 to lock the discharge preventer assembly 100 in place on the firearm 102. The right body portion 120 and left body portion 160 can be joined in the protective condition 300 by connectors known to one skilled in the art. The right body portion 120 and the left body portion 160 can be adapted to connect to each other in a protective condition to collectively receive the trigger 105 and the trigger bow 111 of the trigger guard assembly 106 and to enclose the trigger 105 and the trigger bow 106.

Figure 5:
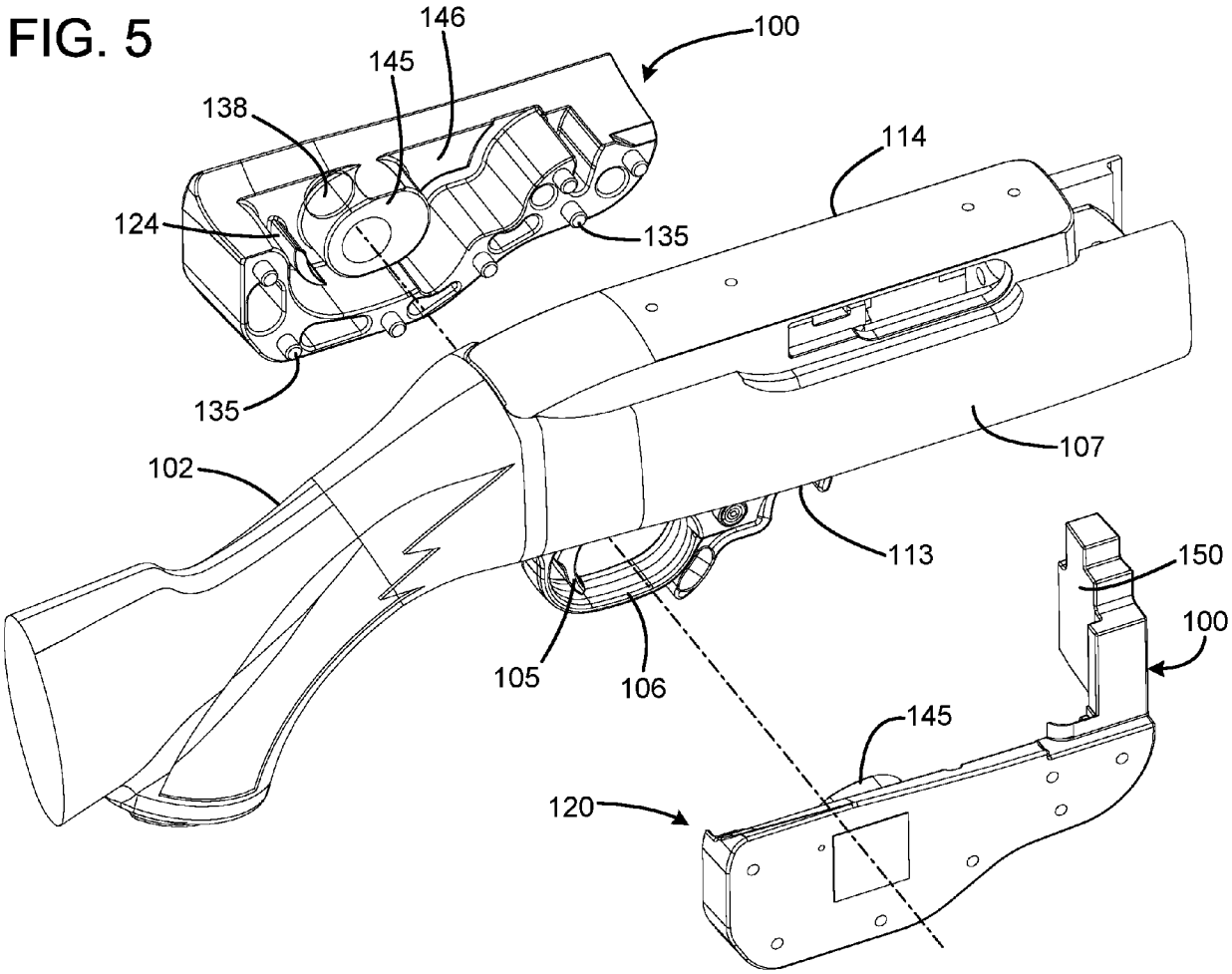
FIG. 5 is an exploded view of the discharge preventer assembly and a firearm.
Figure 6:
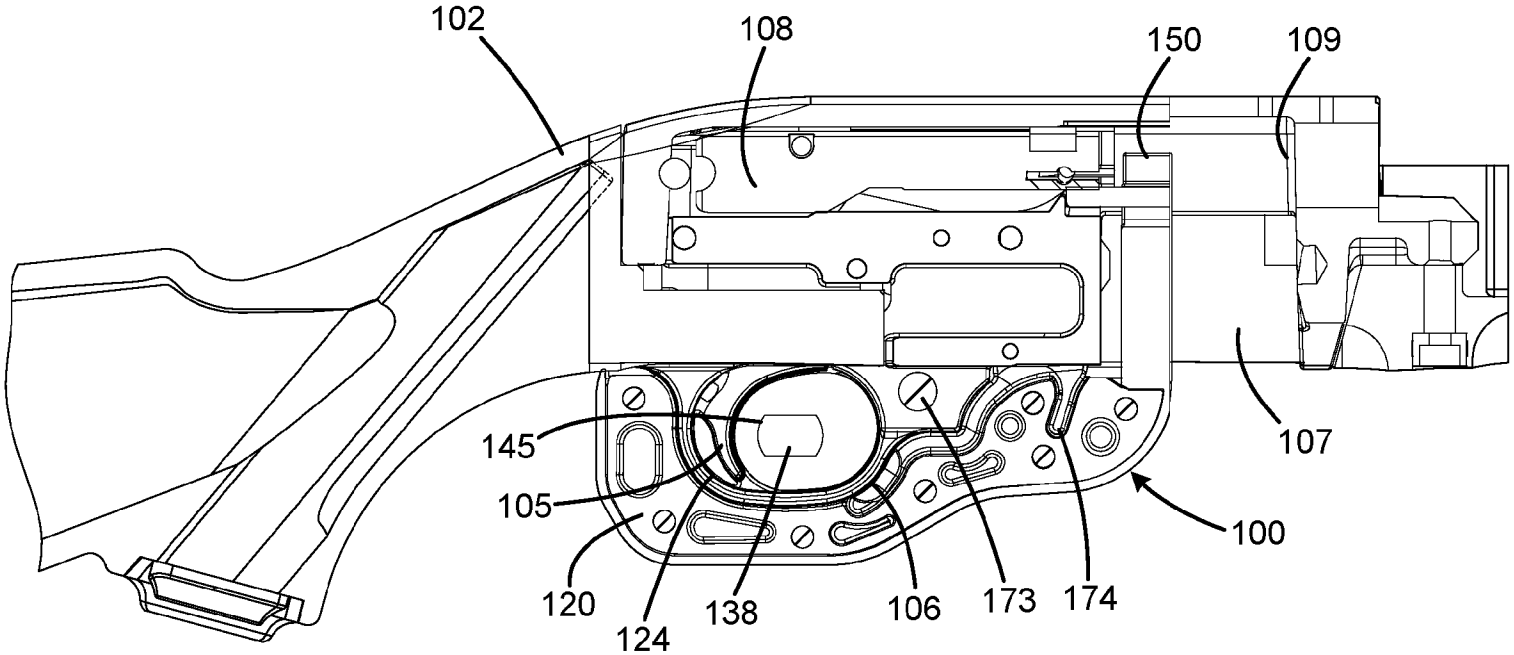
FIG. 6 is a sectional view of the discharge preventer assembly attached to a firearm.
Figure 7:
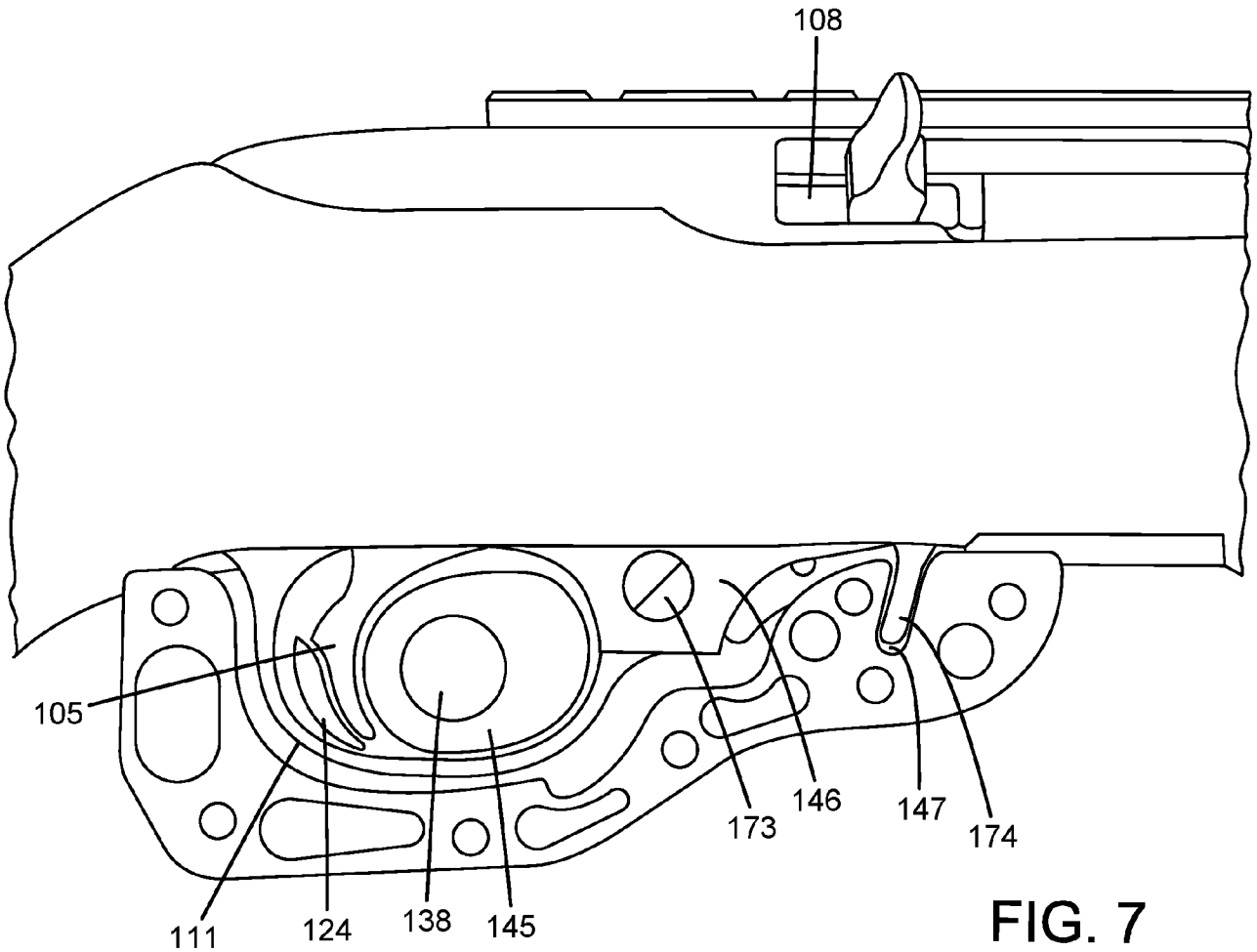
FIG. 7 is a sectional view of the discharge preventer assembly attached to a firearm.

Now referring to FIGS. 5-7, to add the discharge preventer assembly 100 to a standard firearm 102, the bolt 108 is pulled to the retracted position, then the right body portion 120 can be secured to the right side of the firearm 102 and the left body portion 160 can be secured to the left body portion of the firearm 102. The firearm 102 defines a lower stock plane 113, wherein the trigger bow 111 of the trigger guard assembly 106 is below the lower stock plane 113, and the magazine well 107 is above the lower stock plane 113. The first body portion 120 and the second body portion 160 collectively define an upper plane 114 registered with the lower stock plane 113 when the discharge preventer assembly 100 is installed on the firearm 102. The space being below the upper plane 114 and the bolt block element 150 is above the lower plane 113.

Once combined the first body portion and the second body portion are combined, the assembly is in the protective condition 300. The bolt 108 is spaced apart from the breech face 109 by the intervention of the bolt block element 150 positioned in the magazine well 107. The trigger block 145 encloses the trigger 105. The raised surface 146 engages the safety 173 in an ON position. The crescent shaped projection 124 blocks the space between the trigger 105 and the trigger bow 111. The slot 147 receives the magazine release. In this way, a single discharge preventer assembly can prevent accidental firing that occur through essentially any mishandling, misuse, or accident. The redundant mechanism offer an unparalleled safety experience.

Equivalent elements can be substituted for the ones set forth above such that they perform in substantially the same manner in substantially the same way for achieving substantially the same result. It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described is merely exemplary and an explanatory embodiment thereof.

We claim:

1. A discharge preventer assembly for a firearm having a trigger, a trigger guard assembly extending in a downward direction, and defining a bolt passage with a bolt operable to reciprocate within the passage between a battery position in which the bolt abuts a rear-end face of a firearm barrel and a position when the bolt is spaced apart from the rear-end face of a firearm barrel, the firearm defining a magazine well having a lower opening facing the downward direction, the rear-end face of a firearm barrel forward of the opening, and the bolt being rearward of the opening when in the retracted position, the discharge preventer assembly comprising:

a first body portion;

a second body portion;

the first body portion and the second body portion adapted to connect to each other in a protective condition, and including an enclosure facility adapted to define a space collectively receiving and enclosing a trigger bow of the trigger guard assembly and the trigger; and at least one of the first body portion and the second body portion having a bolt block element protruding externally upward from the enclosure facility, the bolt block element having a free end extending into the lower opening of the magazine well, through the magazine well, and into the bolt passage when the first body portion and the second body portion are in the protective condition.

2. The discharge preventer assembly of claim 1 further comprising: a rigid plate incorporated into the first body portion and having a hardness greater than a hardness of the first body portion, wherein the at least one rigid plate is configured to prevent removal of the discharge preventer assembly.

3. The discharge preventer assembly of claim 2 wherein the rigid plate is a metal reinforcing plate coextensive with the trigger bow and the bolt block element.

4. The discharge preventer assembly of claim 1 further comprising: a rigid plate incorporated into the second body portion and having a hardness greater than a hardness of the second body portion, wherein the at least one rigid plate is configured to prevent removal of the discharge preventer assembly.

5. The discharge preventer assembly of claim 4 wherein the rigid plate is a metal reinforcing plate coextensive with the trigger bow and the bolt block element.

6. The discharge preventer assembly of claim 1 further comprising: a lock operably engaging the first body portion or the second body portion.

7. The discharge preventer assembly of claim 1 further comprising: a rigid plate incorporated into the first body portion and a rigid plate incorporated into the second body portion and a plurality of hardened reinforcing pins extending laterally between the first body portion and the second body portion to further protect the trigger and trigger bow from tampering.

8. The discharge preventer assembly of claim 1 further comprising: a projection disposed between the trigger and the trigger bow of the trigger guard assembly of the firearm.

9. The discharge preventer assembly of claim 1 further comprising: a slot in the discharge preventer assembly configured to receive a magazine release of the firearm.

10. The discharge preventer assembly of claim 1 further comprising: a raised surface of the discharge preventer assembly configured to engage the safety of the standard firearm to maintain the safety in an ON position.

11. The discharge preventer assembly of claim 1 further comprising: an ovoid projection disposed to prevent an insertion of a finger in front of the trigger of the firearm.

12. The discharge preventer assembly of claim 1 wherein the firearm defines a lower stock plane, wherein the trigger bow is below the lower stock plane, and the magazine well is above the lower stock plane, and wherein the first and second body portions collectively define an upper plane registered with the lower stock plane when the discharge preventer assembly is installed, the guarded space being below the upper plane and the block element is above the lower plane.

13. A trigger lock for a firearm having a frame, a trigger protruding from the frame and extending in a downward direction, and a magazine well in the frame having a lower opening facing the downward direction, the trigger lock comprising:

a first body portion;

a second body portion adapted to be secured to the first body portion in a locked condition;

when in the locked condition the first body portion and the second body portion collectively defining an enclosure facility adapted to define a protective space adapted to protectively receive the trigger; and at least one of the first body portion and the second body portion including a bolt blocking element configured to protrude externally upward from the enclosure facility and having a free end extending into the lower opening of the magazine well, through the magazine well, and into the bolt passage, when in the locked condition.

14. The trigger lock of claim 13 wherein the bolt blocking element occupies only a minor rear portion of the magazine well.

15. The trigger lock of claim 13 wherein the magazine well has a rear surface, and the firearm has a bolt that remains rearward of the rear surface when the bolt is in a retracted condition, and wherein the bolt blocking element abuts the rear surface, such that the bolt is restrained in the retracted condition when the trigger locked is in the locked condition.

16. The trigger lock of claim 13 wherein the protective space comprises an ovoid projection positioned to prevent the insertion of a finger in front of the trigger.

17. The trigger lock of claim 13 wherein the protective space comprises a crescent shaped projection disposed between and trigger and the trigger bow.

18. The trigger lock of claim 13 wherein the protective space comprises: a slot in the discharge preventer assembly configured to receive a magazine release of the firearm.

19. A method to prevent a firearm having a trigger guard, and defining a bolt passage with a bolt operable between a cocked position in which the bolt abuts a rear-end face of a firearm barrel and a battery position spaced apart from the rear-end face of a firearm barrel, the firearm defining a magazine well having a lower opening, the rear-end face of a firearm barrel forward of the opening, and the bolt being rearward of the opening when in the cocked position, from firing, comprising the steps of:

attaching the discharge preventer assembly of claim 1 to a firearm to form the protective condition, wherein the bolt of the firearm is prevented from contacting the rear-end face of a firearm barrel and wherein the bolt block element is adapted to prevent insertion of a magazine in the magazine well of the firearm.

20. The method of claim 19 further comprising: the step of a locking the discharge preventer assembly by operably engaging the first body portion or the second body portion with a lock.

* * * * *